US010954586B2

(12) United States Patent
Takeda et al.

(10) Patent No.: US 10,954,586 B2
(45) Date of Patent: Mar. 23, 2021

(54) COPPER ALLOY AND METHOD FOR PRODUCING SAME

(71) Applicants: NGK INSULATORS, LTD., Nagoya (JP); National University Corporation YOKOHAMA National University, Yokohama (JP)

(72) Inventors: Mahoto Takeda, Yokohama (JP); Koudai Sasaki, Yokohama (JP); Naokuni Muramatsu, Nagoya (JP); Takanari Nakajima, Nagoya (JP)

(73) Assignees: NGK Insulators, Ltd., Nagoya (JP); National University Corporation Yokohama National University, Yokohama (JP)

( * ) Notice: Subject to any disclaimer, the term of this patent is extended or adjusted under 35 U.S.C. 154(b) by 255 days.

(21) Appl. No.: 15/902,230

(22) Filed: Feb. 22, 2018

(65) Prior Publication Data

US 2018/0209025 A1 Jul. 26, 2018

Related U.S. Application Data

(63) Continuation of application No. PCT/JP2017/012129, filed on Mar. 24, 2017.
(Continued)

(51) Int. Cl.
*C22C 9/02* (2006.01)
*C22F 1/00* (2006.01)
(Continued)

(52) U.S. Cl.
CPC ..... *C22C 9/02* (2013.01); *C22C 9/05* (2013.01); *C22F 1/00* (2013.01); *C22F 1/006* (2013.01); *C22F 1/08* (2013.01); *C22C 9/01* (2013.01)

(58) Field of Classification Search
CPC ..... C22C 1/045; C22C 1/0425; C22C 9/00; C22C 9/01; C22C 9/02; C22F 1/006; C22F 1/08
See application file for complete search history.

(56) References Cited

U.S. PATENT DOCUMENTS 4,036,669 A 7/1977 Brook et al.
4,644,674 A * 2/1987 Burrows ..... A44C 21/00 40/27.5
(Continued)

FOREIGN PATENT DOCUMENTS

SU 484073 A1 * 9/1975
WO 2015/129270 A1 9/2015

OTHER PUBLICATIONS

SU-484073-A1 machine translation (Year: 1975).*
(Continued)

*Primary Examiner* — Anthony J Zimmer
*Assistant Examiner* — Sean P. O'Keefe
(74) *Attorney, Agent, or Firm* — Burr & Brown, PLLC

(57) ABSTRACT

A copper alloy disclosed in the present description has a basic alloy composition represented by $Cu_{100-(x+y)}Sn_xAl_y$ (where 8≤x≤12 and 8≤y≤9 are satisfied), in which a main phase is a βCuSn phase with Al dissolved therein, and the βCuSn phase undergoes martensitic transformation when heat-treated or worked. A method for producing a copper alloy disclosed in the present description is a casting step of melting and casting a raw material containing Cu, Sn, and Al and having a basic alloy composition represented by $Cu_{100-(x+y)}Sn_xAl_y$ (where 8≤x≤12 and 8≤y≤9 are satisfied) so as to obtain a cast material, and a homogenization step of homogenizing the cast material in a temperature range of a βCuSn phase so as to obtain a homogenized material, the method includes at least the casting step.

14 Claims, 9 Drawing Sheets

Related U.S. Application Data

(60) Provisional application No. 62/313,228, filed on Mar. 25, 2016.

(51) Int. Cl.

| | |
|---|---|
| ***C22F 1/08*** | (2006.01) |
| ***C22C 9/01*** | (2006.01) |
| ***C22C 9/05*** | (2006.01) |

(56) References Cited

U.S. PATENT DOCUMENTS

| | | | | |
|---|---|---|---|---|
| 5,975,256 | A * | 11/1999 | Kondoh | B62L 1/00 188/251 A |
| 2003/0049148 | A1* | 3/2003 | Takayama | F16C 33/14 419/8 |
| 2017/0170470 | A1 | 6/2017 | Yamamoto et al. | |

OTHER PUBLICATIONS

*Journal of Textile Engineering*, 42 (1989), pp. 587-592 (with partial translation).

C.M. Wayman, "Some Applications of Shape Memory Alloys," *Journal of the Japan Institute of Metals and Materials*, 19 (1980), pp. 323-332 (with partial translation).

Tomoo Sato et al., "Al—Cu—Sn Sangen-Kei Heiko Jotaizu ni Tsuite Al Gu no Heiko Jotaizu," *Journal of the Japan Institute of Metals*, 1944, vol. 8, No. 1, pp. 14-22.

A.K. Chakrabarty et al., "Isothermal Transformation of β-phase in Cu-rich Cu—Al—Sn Alloys," *International Journal of Materials Research*, 2013, vol. 104, No. 5, pp. 430-441.

X.J. Liu et al., "Phase Stability Among the α(A1), β(A2), and γ(D83) Phases in the Cu—Al-X System," *Journal of Phase Equilibria*, 2001, vol. 22, No. 4, pp. 431-438.

International Search Report and Written Opinion (Application No. PCT/JP2017/012129) dated Jun. 6, 2017.

Rupa Dasgupta, "A Look into Cu-based Shape Memory Alloys: Present Scenario and Future Prospects," *Journal of Material Research Society*, vol. 29, No. 16., Aug. 28, 2014, pp. 1681-1698. XP002789714.

J. Van Humbeeck, et al., "Shape Memory Alloys, Types and Functionalities," https://onlinelibrary.wiley.com/full/10.1002/0471216275.esm073, *Encyclopedia of Smart Materials*, Jul. 15, 2002. XP002789715. Retrieved from the Internet on Mar. 14, 2019.

S. Prashantha et al, Shape Memory Effect in Cu—Sn—Mn Ternary Shape Memory Alloy Processed by Ingot Metallurgy, *International Journal of Metallurgical & Materials Science and Engineering*, vol. 2, No. 1, Mar. 1, 2012, pp. 12-20. XP055550774.

X.J. Liu, et al., "Experimental Investigation and Thermodynamic Calculation of the Phase Equilibria in the Cu—Sn and Cu—Sn—Mn Systems," *Metallurgical and Materials Transactions A*, vol. 35A, Jun. 30, 2004, pp. 1641-1653. XP002789717.

X. J. Liu, et al, "Experimental Investigation and Thermodynamic Calculation of the Phase Equilibria in the Cu—Sn and Cu—Sn—Mn Systems," *Metallurgical and Materials Transactions A*, vol. 35, No. 6., Jun. 1, 2004, pp. 1641-1654. XP019694973.

Extended European Search Report (Application No. 17770436.8) dated Apr. 8, 2019.

English translation of International Preliminary Report on Patentability (Application No. PCT/JP2017/012129) dated Oct. 4, 2018.

* cited by examiner

COPPER ALLOY AND METHOD FOR PRODUCING SAME

BACKGROUND OP THE INVENTION

1. Field of the Invention

The disclosure in the present description relates to a copper alloy and a Method for producing same.

2. Description of the Related Art

Proposals of copper alloys having shape memory properties (for example, see NPL 1 and NPL 2, etc.) have been made heretofore. Examples of such copper alloys include Cu—Zn alloys, Cu—Al alloys, and Cu—Sn alloys. These copper shape memory alloys all have a parent phase called a β phase (phase having a crystal structure related to bcc) that is stable at high temperature, and this parent phase contains regularly ordered alloy elements. When the β phase is quenched to about room temperature to enter a metastable state, and is then further cooled, the β phase undergoes martensitic transformation and its crystal structure changes instantaneously.

CITATION LIST

Non Patent Literature

NPL 1: Journal of Textile Engineering, 42 (1989), 587

NFL 2: Journal of the Japan Institute of Metals and Materials, 19 (1980), 323

SUMMARY OF THE INVENTION

Among these copper alloys, Cu—Zn—Al, Cu—Zn—Sn, and Cu—Al—Mn copper alloys are advantageous in terms of cost due to their low raw material cost; however, they do not have as high a recovery rate as Ni—Ti alloys, which are common shape memory alloys. Ni—Ti alloys have excellent SME properties, in other words, a high recovery rate, but are expensive due to high Ti contents. Moreover, Ni—Ti alloys have low thermal and electrical conductivity and can only be used at a low temperature, 100° C. or lower. For Cu—Sn alloys, the problem has been that the internal structure changes with time due to room-temperature aging, and the shape memory properties change as a result. Since room-temperature aging causes diffusion of Sn and induces precipitation of a S n-rich s phase and a Sn-rich L phase, which is the coarsened phase of the s phase, the shape memory properties tend to change easily. The s and L phases are Sn-rich phases and can give precipitates such as γCuSn, δCuSn, and εCnSn with progress of eutectoid transformation. Because Cu—Sn alloys undergo significant changes in their properties with time, such as significant changes in transformation temperatures upon being left to stand at a relatively low temperature near room temperature, Cu—Sn alloys have been subject of basic research but not practical applications. As such, copper alloys that undergo reverse transformation in a high temperature range of about 500° C. to 700° C. and stress-induced martensitic transformation have not achieved the practical use so far.

The disclosure has been made to address these issues. A main object thereof is to provide a novel Cu—Sn copper alloy that stably exhibits shape memory properties and to provide a method for producing same.

Solution to Problem

The copper alloy and method for producing same disclosed in the present description have taken the following measures to achieve the main object described above.

A copper alloy disclosed in the present description has a basic alloy composition represented by $Cu_{100-(x+y)}Sn_xAl_y$ (where $8 \leq x \leq 12$ and $8 \leq y \leq 9$ are satisfied), in which a main phase is a βCuSn phase with Al dissolved therein, and the βCuSn phase undergoes martensitic transformation when heat-treated or worked.

A method for producing a copper alloy disclosed in the present description is a method for producing a copper alloy that undergoes martensitic transformation when heat-treated or worked. Among a casting step of melting and casting a raw material containing Cu, Sn, and Al and having a basic alloy composition represented by $Cu_{100-(x+y)}Sn_xAl_y$ (where $8 \leq x \leq 12$ and $8 \leq y \leq 9$ are satisfied) so as to obtain a cast material, and a homogenization step of homogenizing the east material in a temperature range of a βCuSn phase so as to obtain a homogenized material, the method includes at least the casting step.

The copper alloy and method fox producing same according to the present disclosure can provide a novel Cu—Sn copper alloy that stably exhibits shape memory properties and a method for producing same. The reason behind such effects is presumably as follows. For example, the additive element Al presumably further stabilizes the β phase of the alloy at room temperature. In addition, addition of Al presumably suppresses slip deformation caused by dislocation and inhibits plastic deformation, thereby further improving the recovery rate.

DETAILED DESCRIPTION OF THE INVENTION

[Copper Alloy]

Figure 1:
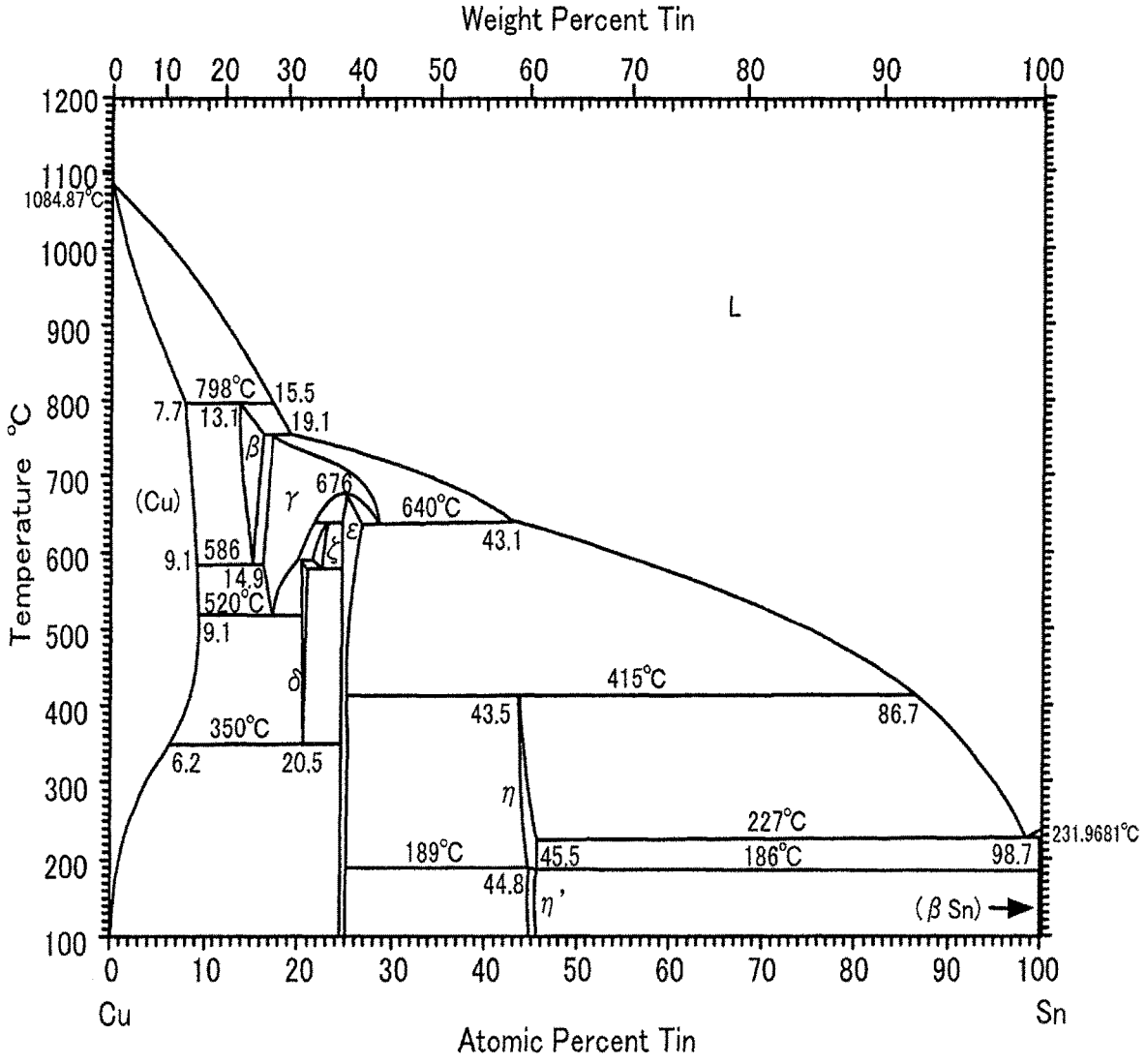
FIG. 1 is an experimental binary phase diagram of Cu—Sn alloys.

The copper alloy disclosed in the present description has a basic alloy composition represented, by $Cu_{100-(x+y)}Sn_xAl_y$ (where $8 \leq x \leq 12$ and $8 \leq y \leq 9$ are satisfied), a main phase thereof is a βCuSn phase with Al dissolved therein, and the βCuSn phase undergoes martensitic transformation when heat-treated or worked. Here, the main phase refers to the phase that accounts for the largest proportion in the entirety. For example, the main phase may be a phase that accounts for 50% by mass or more, may be a phase that accounts for 80% by mass or more, or may be a phase that accounts for 90% by mass or more. In the copper alloy, the βCuSn phase accounts for 95% by mass or more and more preferably 98% by mass or more. The copper alloy may be treated at a temperature of 500° C. or higher and then cooled, and may have at least one selected from a shape memory effect and a super elastic effect at a temperature equal to or lower than the melting point. Since the main phase of the copper alloy is the βCuSn phase, a shape memory effect or a super elastic effect can be exhibited. Alternatively, the area ratio of the βCuSn phase contained in the copper alloy may be in the range of 50% or more and 100% or less in surface observation. The main phase may be determined by surface observation as such. The area ratio of the βCuSn phase may be 95% or more and is more preferably 98% or more. The copper alloy most preferably contains the βCuSn phase as a single phase, but may contain other phases.

The copper alloy may contain 8 at % or more and 12 at % or less of Sn, 8 at % or more and 9 at % or less of Al, and the balance being Cu and unavoidable impurities. When 8 at % or more of Al is contained, the self recovery rate can be further increased. When 9 at % or less of Al is contained, the decrease in electrical conductivity and the decrease in self recovery rate can be further suppressed. When 8 at % or more of Sn is contained, the self recovery rate can be further increased. When 12 at % or less of Sn is contained, the decrease in electrical conductivity and the decrease in self recovery rate can be further suppressed. Examples of the unavoidable impurities can be at least one selected from Fe, Pb, Bi, Cd, Sb, S, As, Se, and Te, and the total amount of the unavoidable impurities is preferably 0.5 at % or less, more preferably 0.2 at % or less, and yet more preferably 0.1 at % or less.

The elastic recovery (%) of the copper alloy determined from an angle $\theta_1$ observed when a flat plate of the copper alloy is unloaded after being bent at a bending angle of $\theta_0$ is preferably 40% or more. The preferable elastic recovery for shape memory alloys and super elastic alloys is 40% or more. An elastic recovery of 18% or more indicates that there has been recovery (shape memory properties) induced by reverse transformation of martensite, not mere plastic deformation. The elastic recovery is preferably high, for example, is preferably 45% or more and more preferably 50% or more. The bending angle $\theta_0$ is to be 45°.

$$\text{Elastic recovery } R_E\,[\%]=(1-\theta_1/\theta_0)\times 100 \quad \text{(mathematical formula 1)}$$

The thermal recovery (%) of the copper alloy obtained from an angle $\theta_2$ observed when a flat plate of the copper alloy is heated to a particular recovery temperature, which is determined on the basis of the βCuSn phase, after being bent at a bending angle of $\theta_0$ is preferably 40% or more. The preferable thermal recovery of shape memory alloys and super elastic alloys is 40% or more. The thermal recovery may be determined from the formula below by using the aforementioned angle $\theta_1$ observed at the time of unloading. The thermal recovery is preferably high, for example, preferably 45% or more and more preferably 50% or more. The heat treatment for recovery is preferably conducted in the range of 500° C. or higher and 800° C. or lower, for example. The time for the heat treatment depends on the shape and size of the copper alloy, and may be a short time, for example, 10 seconds or shorter.

$$\text{Thermal recovery } R_T\,[\%]=(1-\theta_2/\theta_1)\times 100 \quad \text{(mathematical formula 2)}$$

The elastic thermal recovery (%) of the copper allay determined from an angle $\theta_1$, which is observed when a flat plate of the copper alloy is unloaded after being bent at a bending angle of $\theta_0$, and an angle $\theta_2$, which is observed when the flat plate is further heated to a particular recovery temperature determined on the basis of the βCuSn phase, is preferably 80% or more. The preferable elastic thermal recovery of shape memory alloys and super elastic alloys is 80% or more. The elastic thermal recovery [%] may be determined from the formula below by using the average elastic recovery. The elastic thermal recovery is preferably high, for example, is preferably 85% or more and more preferably 90% or more.

$$\text{Elastic thermal recovery } R_{E+T}\,[\%]=\text{average elastic recovery}+(1-\theta_2/\theta_1)\times(1-\text{average elastic recovery}) \quad \text{(mathematical formula 3)}$$

The copper alloy may be a polycrystal or a single crystal. The copper alloy may have a crystal grain diameter of 100 μm or more. The crystal grain diameter is preferably large, and a single crystal is preferred over a polycrystal. This is because the shape memory effect and the super elastic effect easily emerge. The cast material for the copper alloy is preferably a homogenized material subjected to homogenization. Since the copper alloy after casting sometimes has a residual solidification structure, homogenization treatment is preferably conducted.

The copper alloy may have an Ms point (the start point temperature of martensitic transformation during cooling) and an As point (the start point temperature of reverse transformation from martensite to the βCuSn phase) that change with the Sn and Al contents. Since the Ms point and the As point of such a copper alloy change according to the Al content, various properties, such as emergence of various effects, can be easily adjusted.

[Method for Producing Copper Alloy]

The method for producing a copper alloy that undergoes martensitic transformation on when heat-treated or worked includes, among a casting step and a homogenization step, at least the casting step.

(Casting Step)

In the casting step, a raw material containing Cu, Sn, and Al and having a basic alloy composition represented by $Cu_{100-(x+y)}Sn_xAl_y$ (where $8 \leq x \leq 12$ and $8 \leq y \leq 9$ are satisfied) is melted and casted to obtain a cast material. In this step, the raw material may be melted and casted to obtain a cast material having a βCuSn phase as the main phase. Examples of the raw materials for Cu, Sn, and Al that can be used include single-metal materials thereof and alloys containing two or more of Cu, Sn, and Al. The blend ratio of the raw material may be adjusted according to the desired basic alloy composition. In this step, in order to have Al dissolved in the CuSn phase, the raw materials are preferably added so that the order of melting is Cu, Al, and then Sn, and casted. The melting method is not particularly limited, but a high frequency melting method is preferred for its efficiency and industrial viability. The casting step is preferably conducted in an inert gas atmosphere such as in nitrogen, Ar, or vacuum. Oxidation of the cast product can be further suppressed. In this step, the raw material is preferably melted in the temperature range of 750° C. or higher and 1300° C. or lower, and cooled at a cooling rate of −50° C./s to −500° C./s from 800° C. to 400° C. The cooling rate is preferably high in order to obtain a stable βCuSn phase.

(Homogenization Step)

In the homogenization step, the cast material is homogenized within the temperature range of the βCuSn phase to obtain a homogenized material. In this step, the cast material is preferably held in the temperature range of 600° C. or higher and 850° C. or lower and then cooled at a cooling rate of −50° C./s to −500° C./s. The cooling rate is preferably high in order to obtain a stable βCuSn phase. The homogenization temperature is, for example, preferably 650° C. or higher and more preferably 700° C. or higher. The homogenization temperature is preferably 800° C. or lower and more preferably 750° C. or lower. The homogenization time may be, for example, 20 minutes or longer or 30 minutes or longer. The homogenization time may be, for example, 48 hours or shorter or 24 hours or shorter. The homogenization treatment is also preferably conducted in an inert atmosphere such as in nitrogen, Ar, or vacuum, (Other Steps)

After the casting step or the homogenization step, other steps may be performed. For example, the method for producing a copper alloy may further include at least one working step of cold-working or hot-working at least one selected from a cast material and a homogenized material into at least one shape selected from a plate shape, a foil shape, a bar shape, a line shape, and a particular shape. In this working step, hot working may be conducted in the temperature range of 500° C. or higher and 700° C. or lower and then cooling may be conducted at a cooling rate of −50° C./s to −500° C./s. In the working step, working may be conducted by a method that suppresses occurrence of shear deformation so that a reduction in area is 50% or less. Alternatively, the method for producing a copper alloy may further include an aging step of subjecting at least one selected from the cast material and the homogenized material to an age hardening treatment so as to obtain an age-hardened material. Alternatively, the method for producing a copper alloy may further include an ordering step of subjecting at least one selected from the cast material and the homogenized material to an ordering treatment so as to obtain an ordered material. In this step, the age-hardening treatment or the ordering treatment may be conducted in the temperature range of 100° C. or higher and 400° C. or lower for a time period of 0.5 hours or longer and 24 hours or shorter.

The present disclosure described in detail above can provide a novel Cu—Sn copper alloy that stably exhibits the shape memory properties and a method for producing same. The reason behind these effects is, for example, presumed, to be as follows. For example, the additive element Al presumably makes the β phase of the alloy more stable at room temperature. Moreover, addition of Al presumably suppresses slip deformation caused by dislocation and inhibits plastic deformation, thereby further improving the recovery rate.

The present disclosure is not limited to the above-described embodiment, and can be carried out by various modes as long as they belong to the technical scope of the disclosure.

EXAMPLES

In the description below, examples in which copper alloys were actually produced are described as experimental examples.

CuSn alloys have excellent castability and are considered to rarely undergo eutectoid transformation, which is one cause for degradation of shape memory properties, because the eutectic point of βCuSn is high. In the present disclosure, inducing emergence of and controlling the shape memory properties by adding a third additive element X (Al) to CuSn alloys were attempted.

Experimental Example 1

A Cu—Sn—Al alloy was prepared. With reference to a Cu—Sn binary phase diagram (FIG. 1), a composition with which a βCuSn single phase was formed as the constituent phase of the subject sample at high temperature was set to be the target composition. The phase diagram referred is an experimental phase diagram derived from ASM International DESK HANDBOOK Phase Diagrams for Binary Alloys, Second Edition (5) and ASM International Handbook of Ternary Alloy Phase Diagrams. Pure Cu, pure Sn, and pure Al were weighed so that the molten alloy would have a composition close to the target composition, and then alloy samples were prepared by melting and casting the raw material while blowing $N_2$ gas in an air high-frequency melting furnace. The target composition was set to $Cu_{100-(x+y)}Sn_xAl_y$ (x=10, y=8.6), and the order of melting was set to Cu→Al→Sn. Since melted and casted samples have solidification structures and are inhomogeneous as are, a homogenization treatment was conducted. During this process, in order to prevent oxidation, samples were vacuum-sealed in quartz tubes, held at 750° C. (1023 K) for 30 minutes in a muffle furnace, and rapidly cooled by placing the tubes in ice water while breaking the quart tubes at the same time.

(Optical Microscope Observation)

The alloy ingot was cut to a thickness of 0.2 to 0.3 mm with a fine cutter and a micro cutter, and the cut piece was mechanically polished with a rotating polisher equipped with waterproof abrasive paper No. 100 to 2000. Then the resulting piece was buff-polished with an alumina solution (alumina diameter: 0.3 μm), and a mirror surface was obtained as a result. Since optical microscope observation samples were also handled as bending test samples, the sample thickness was made uniform and then the samples were heat-treated (supercooled high-temperature phase formation treatment). The sample thickness was set to 0.1 mm. In the optical microscope observation, a digital microscope, VH-8000 produced by Keyence Corporation was used. The possible magnification of this device was 450× to 3000×, but observation was basically conducted at a magnification of 450×.

(X-ray Powder Diffraction Measurement: XRD)

XRD measurement samples were prepared as follows. The alloy ingot was cut with a fine cutter, and edges were filed with a metal file to obtain a powder sample. The sample was heat-treated to prepare an XRD measurement sample. In quenching, the quartz tube was left unbroken during cooling since if the quartz tube was caused to break in water as with normal samples, the powder sample may contain moisture and may become oxidized. The XRD diffractometer used was RINT2500 produced by Rigaku Corporation. The diffractometer was a rotating-anode X-ray diffractometer. The measurement was conducted under the following conditions: rotor target serving as rotating anode: Cu, tube voltage: 40 kV, tube current: 200 mA, measurement range; 10° to 120°, sampling width: 0.02°, measurement rate: 2°/minute, divergence slit angle: 1°, scattering slit angle: 1°, receiving slit width: 0.3 mm. In data analysis, a powder diffraction analysis software suite Rigaku PDXL was used to analyze the peaks emerged, identify the phases, and calculate the phase volume fractions. Note that PDXL employs the Hanawalt method for peak identification.

(Transmission Electron Microscope Observation: TEM)

TEM observation samples were prepared as follows. The melted and casted alloy ingot was cut with a fine cutter and a micro cutter to a thickness of 0.2 to 0.3 mm, and the cut piece was mechanically polished with a rotating polisher equipped with a No. 2000 waterproof abrasive paper to a thickness of 0.15 to 0.25 mm. This thin-film sample was shaped into a 3 mm square, heat-treated, and electrolytically polished under the following conditions. In electrolytic polishing, nital was used as the electrolytic polishing solution, and jet polishing was conducted while keeping the temperature at about −20° C. to −10° C. (253 to 263 K). The electrolytic polisher used was TenuPol produced by STRUERS, and polishing was conducted under the following conditions: voltage: 10 to 15 V, current: 0.5 A, flow rate: 2.5. The sample was observed immediately after completion of electrolytic polishing. In TEM observation, Hitachi H-800 (side entry analysis mode) TEM (accelerating voltage: 175 kV) was used.

(Macroscopic Observation of Shape Memory Properties: Bending Test)

Figure 2:
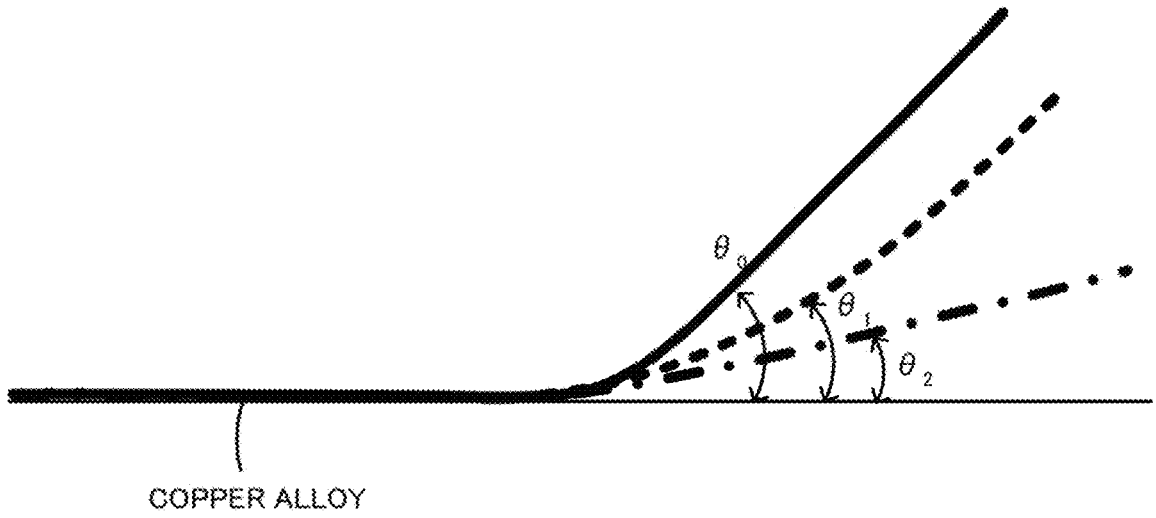
FIG. 2 is a diagram illustrating angles involved in recovery rate measurement.

The alloy ingot was cut with a fine cutter and a micro cutter to a thickness of 0.3 mm, and the cut piece was mechanically polished with a rotating polisher equipped with waterproof abrasive paper No. 100 to 2000 so that the thickness was 0.1 mm. The same treatment as that for the sample for the optical microscope observation was conducted, and the sample after the heat treatment was wound around a guide having R=0.75 mm. Then bending deformation was applied by bending the sample at a bending angle of 45°. The bending angle $\theta_0$ (45°) of the sample, the angle $\theta_1$ after unloading, and the angle $\theta_2$ after the heat treatment at 750° C. (1023 K) for 1 minute were measured, and the elastic recovery and the thermal recovery were determined from the following formulae. A recovery-temperature curve was also obtained by changing the heating temperature after deformation. In obtaining the recovery-temperature curve, since the stress applied during bending cannot be made uniform among the samples, the angles (elastic recovery) of the samples at the time of unloading axe likely to vary. Thus, the elastic+thermal recovery was determined from the following formula by correcting the thermal recovery on the basis of the average value of the elastic recovery. FIG. 2 is a diagram, illustrating angles involved in recovery measurement.

$$\text{Elastic recovery [\%]}=(1-\theta_1/\theta_0)\times 100 \quad \text{(mathematical formula 1)}$$

$$\text{Thermal recovery [\%]}=(1-\theta_2/\theta_1)\times 100 \quad \text{(mathematical formula 2)}$$

$$\text{Elastic+thermal recovery [\%]}=\text{average elastic recovery}+(1-\theta_2/\theta_1)\times(1-\text{average elastic recovery}) \quad \text{(mathematical formula 3)}$$

Figure 3A:
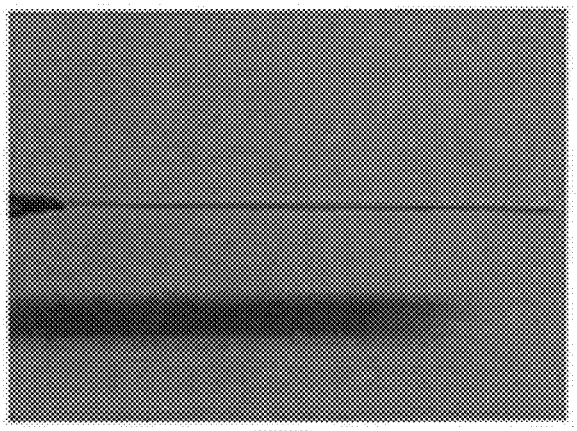
FIGS. 3A to 3C show macroscopic observation results of shape memory properties of an alloy foil of Experimental Example 1.
Figure 3B:
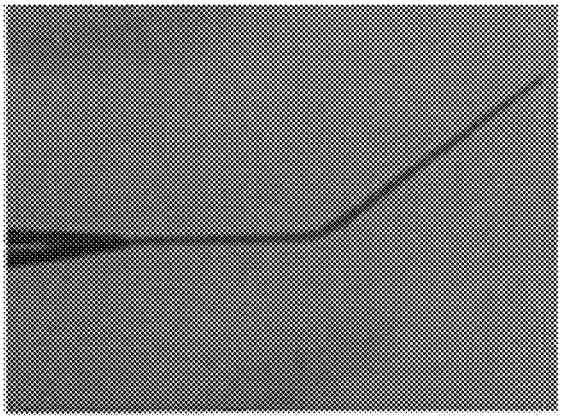
Figure 3C:
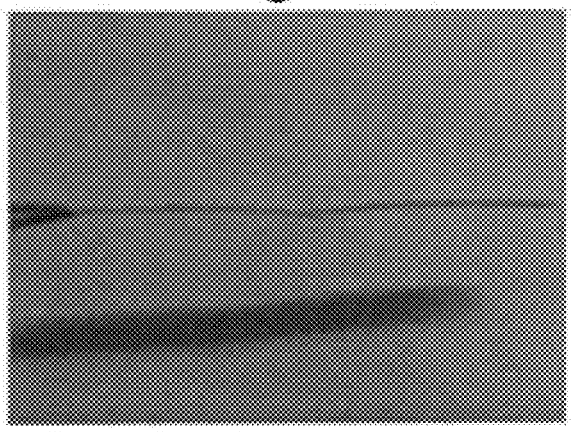
Figure 4A:
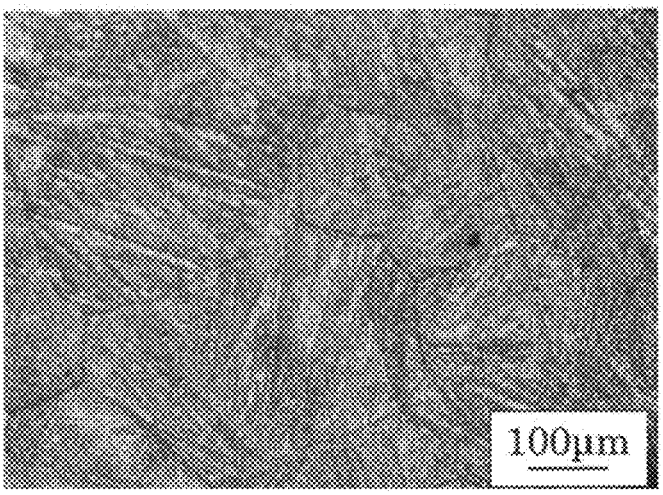
FIGS. 4A to 4C show optical microscope observation results of the alloy foil of Experimental Example 1.
Figure 4B:
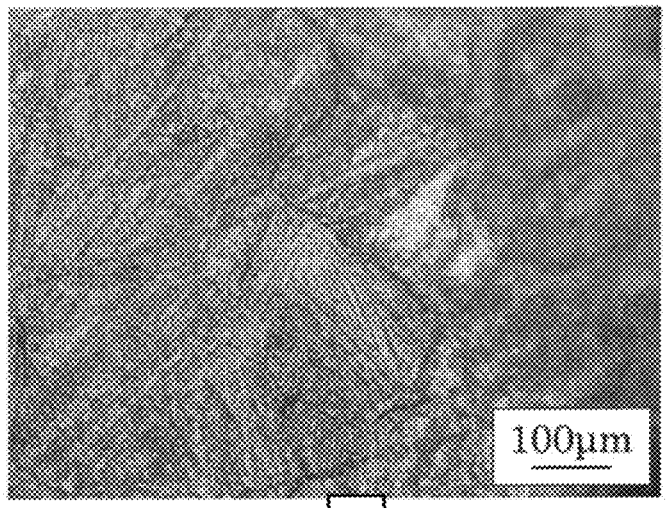
Figure 4C:
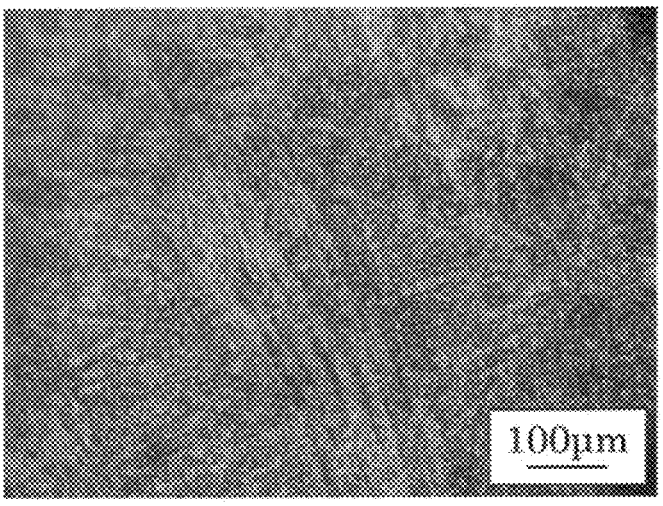
Figure 5:
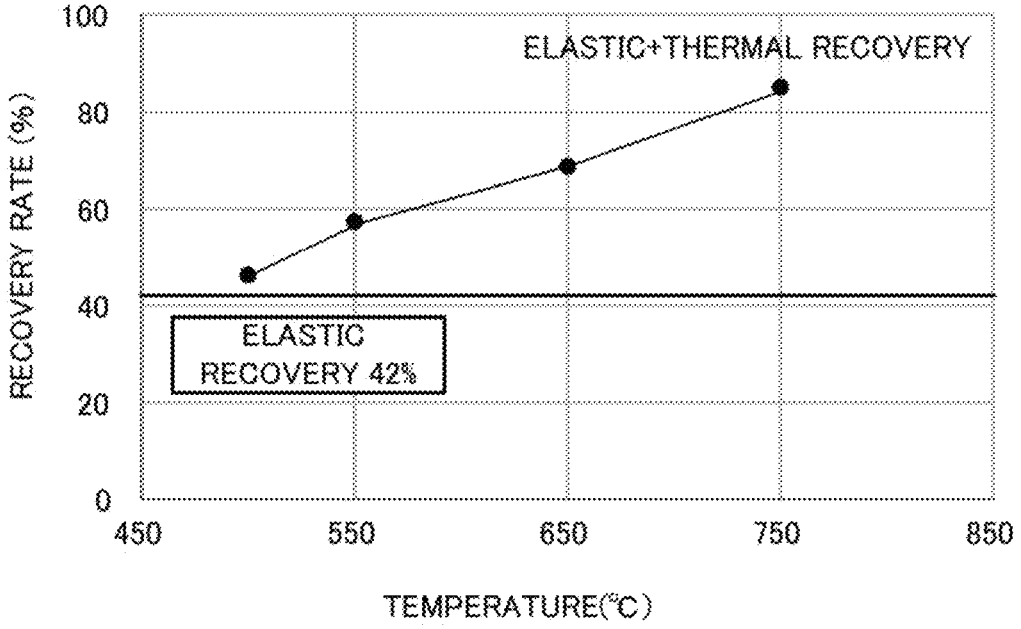
FIG. 5 is a graph showing the relationship between the temperatures and the elastic thermal recovery of Experimental Example 1.
Figure 6:
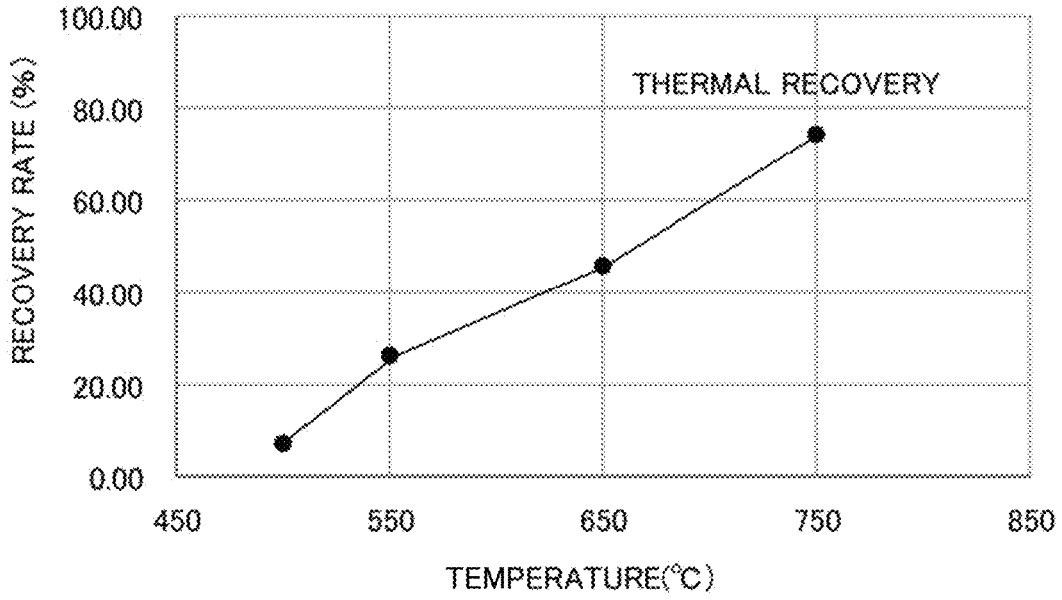
FIG. 6 is a graph showing the relationship between the temperatures and the thermal recovery of Experimental Example 1.

The structure of the homogenized sample was observed after the treatment, during deformation, and after heat treatment (unloading). FIGS. 3A to 3C show macroscopic observation results of the shape memory properties of the alloy foil of Experimental Example 1. FIG. 3A is a photograph taken after the homogenization treatment, FIG. 3B is a photograph taken during bending deformation, and FIG. 3C is a photograph taken after thermal recovery. FIGS. 4A to 4C show optical microscope observation results of the alloy foil of Experimental Example 1. FIG. 4A is a photograph taken after the homogenization treatment, FIG. 4B is a photograph taken during bending deformation, and FIG. 4C is a photograph taken after thermal recovery. FIG. 5 is a graph showing the relationship between the temperatures and the elastic+thermal recovery of Experimental Example 1. FIG. 6 is a graph showing the relationship between the temperatures and the thermal recovery of Experimental Example 1. In Table 1, the measurement results of Experimental Example 1 are summarized. As shown in FIG. 3B, when the sample of Experimental Example 1 was deformed by bending, permanent strain remained; and, as shown in FIG. 3C, when the sample was heat-treated at 750° C. (1023 K) for 1 minute, the shape was recovered. After the homogenization treatment and during bending deformation, thermal martensite was observed (FIGS. 4A and 4B). No significant change was observed between after the homogenization treatment and during bending deformation. After the heat treatment, the martensite was almost extinct (FIG. 4C). In Experimental Example 1, the elastic recovery was 42%, and the heat-treated sample significantly recovered at 500° C. (773 K) or higher, and the elastic+thermal recovery reached 85% (FIG. 5).

TABLE 1

| | Measured Temperature | | Permanent Deformation Thermal Recovery | Elastic Recovery | Average Elastic Permanent Deformation Thermal Recovery |
|---|---|---|---|---|---|
| | ° C. | K | % | % | % |
| Experimental Example 1 | 20 | 293 | 0 | | 42.22 |
| | 500 | 773 | 7.14 | 68.89 | 46.35 |
| | 550 | 823 | 26.32 | 57.78 | 57.43 |
| | 650 | 923 | 45.83 | 46.67 | 68.70 |
| | 750 | 1023 | 74.29 | 22.22 | 85.14 |
| | Average Elastic Recovery (%) | | | 42.22 | |
| | Average Permanent Deformation (%) | | | 57.78 | |

Experimental Example 2

Figure 7A:
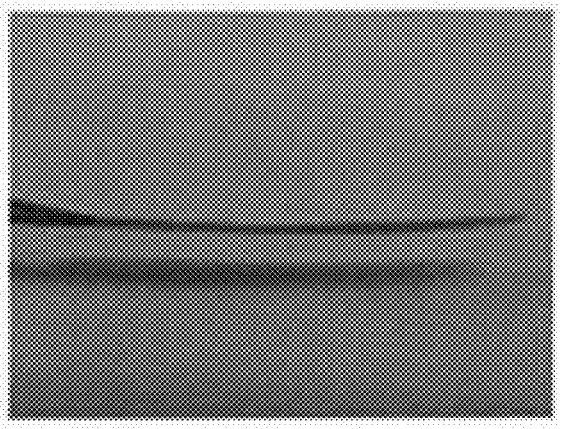
FIGS. 7A to 7C show macroscopic observation results of shape memory properties of an alloy foil of Experimental Example 2.
Figure 7B:
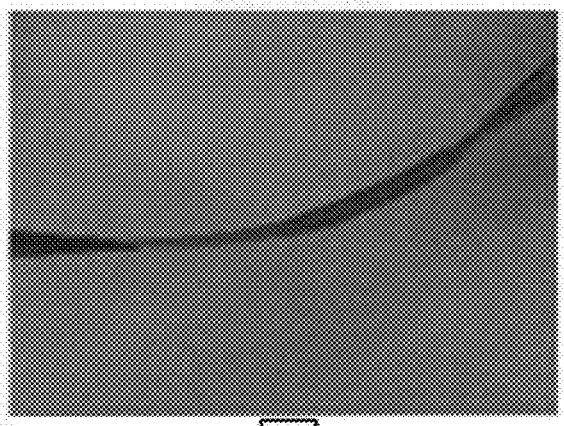
Figure 7C:
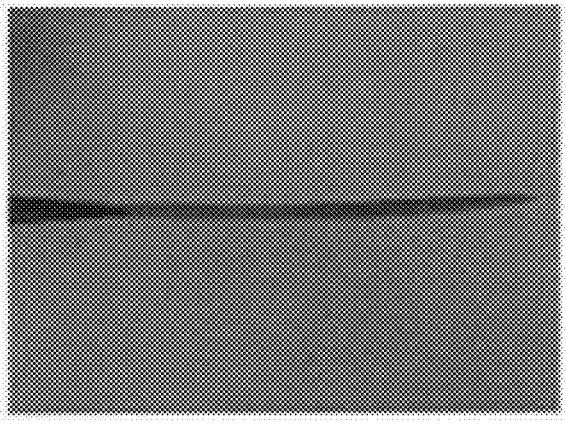
Figure 8A:
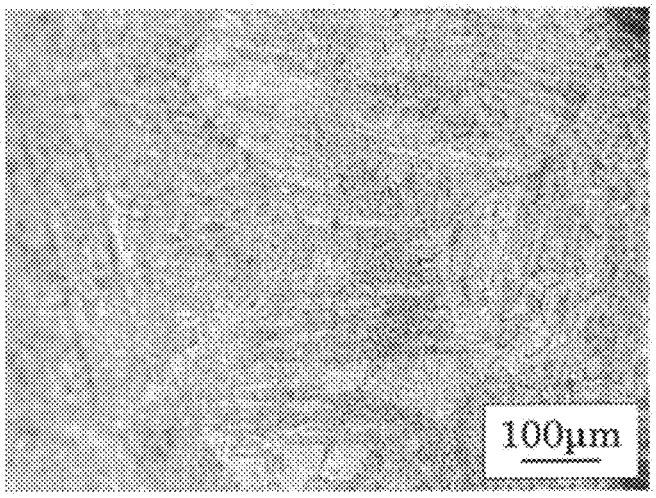
FIGS. 8A to 8C show optical microscope observation results of the alloy foil of Experimental Example 2.
Figure 8B:
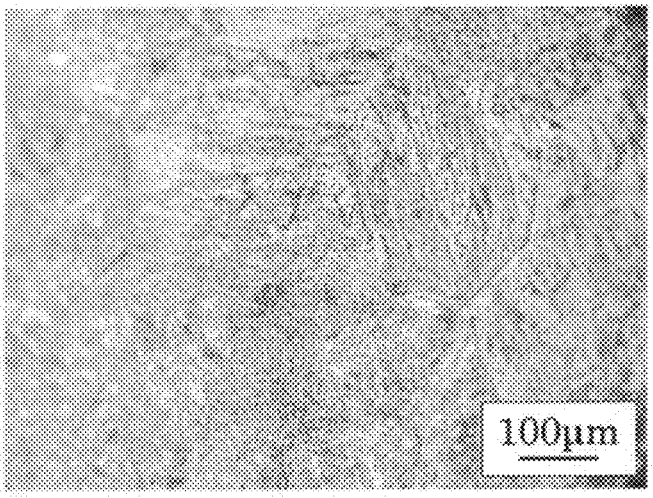
Figure 8C:
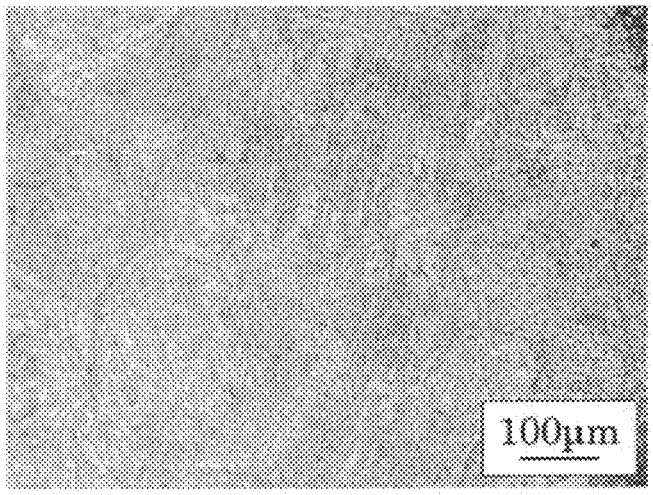

The copper alloy of Experimental Example 1 was aged at room temperature for 10,000 minutes to prepare Experimental Example 2. The same measurement was conducted on Experimental Example 2 as in Experimental Example 1. FIGS. 7A to 7C show macroscopic observation results of the shape memory properties of the alloy foil of Experimental Example 2. FIG. 7A is a photograph taken after the homogenization treatment, FIG. 7B is a photograph taken during bending deformation, and FIG. 7C is a photograph taken after thermal recovery. FIGS. 8A to 8C show the optical microscope observation results of the alloy foil of Experimental Example 2. FIG. 8A is a photograph taken after the homogenization treatment, FIG. 8B is a photograph taken during bending deformation, and FIG. 8C is a photograph taken after thermal recovery. As shown in FIG. 7B, when Experimental Example 2 was deformed by bending, the shape recovered after unloading. After the homogenization treatment and during deformation, thermal martensite was observed (FIGS. 8A and 8B). No significant change was observed between after the homogenization treatment and during bending deformation. Martensite remained after unloading (FIG. 8C). As shown in FIGS. 7 and 8, in Experimental Example 2 also, elastic recovery occurred and recovery was significant when the heat treatment was conducted. In other words, it was found that the shape memory properties were maintained even when the sample was aged at room temperature.

(Studies)

Experimental Example 1 exhibited the shape memory effect, and thermal martensite was observed after the homogenization treatment and during deformation. Moreover, no significant change was observed between after the homogenization treatment and during deformation. After the heat treatment, martensite was almost extinct. These results show that the shape memory effect is probably brought by the thermal martensite. The average elastic recovery of the sample was 42%, significant recovery occurred at 500° C. (773 K) or higher when the sample was heated, and the elastic+thermal recovery reached 85%. Compared to the Cu-14 at % Sn alloy, the elastic recovery increased from 35% to 42%. It was assumed that addition of Al suppressed slip deformation caused by dislocation and inhibited plastic deformation. Experimental Example 2 exhibited superelasticity, and thermal martensite was observed after the homogenization treatment and during deformation. No significant difference was observed between after the homogenization treatment and during deformation. The martensite remained after unloading. Whether the superelasticity is brought by the thermal martensite is not clear, but possibly, the change in shape memory properties is induced by room-temperature aging for the same reason as that for the Cu-14 at % Sn alloy involving stress-induced martensite not detectable under the optical microscope observation. In Experimental Example 1, although the thermal martensite was observed, the reverse transformation temperature (500° C. (773 K) or higher) and changes in shape memory properties due to room-temperature aging were very similar to the shape memory properties brought by the stress-induced martensite in the Cu-14 at % Sn alloy. If Experimental Example 1 contained βCuSn, it is possible that stress-induced martensite not detectable under the optical microscope observation may be present in Experimental Example 1 also.

Figure 9:
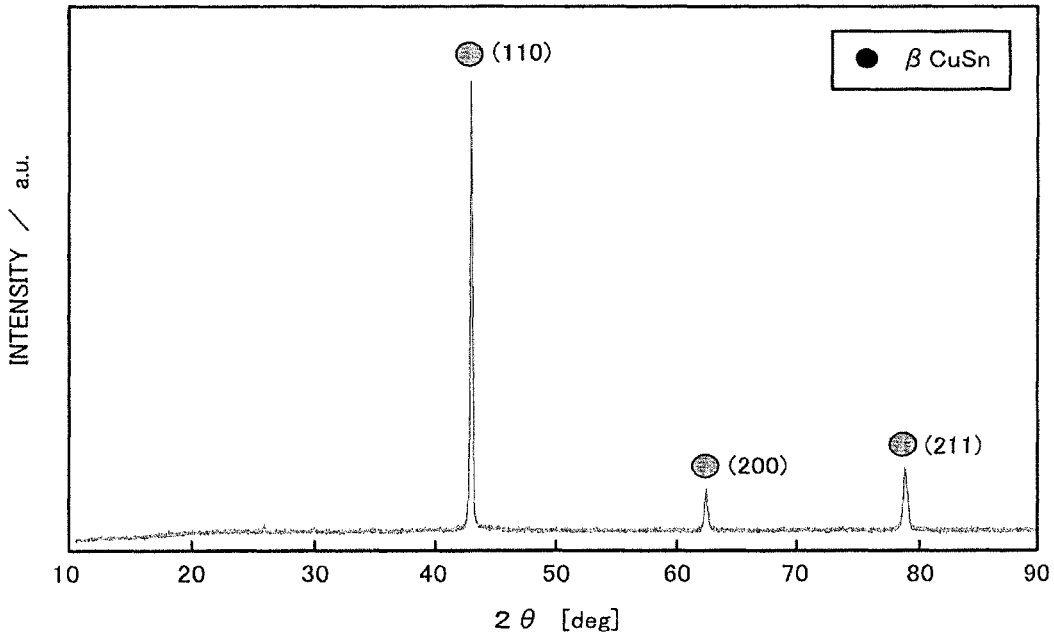
FIG. 9 shows XRD measurement results of Experimental Example 1.
Figure 10:
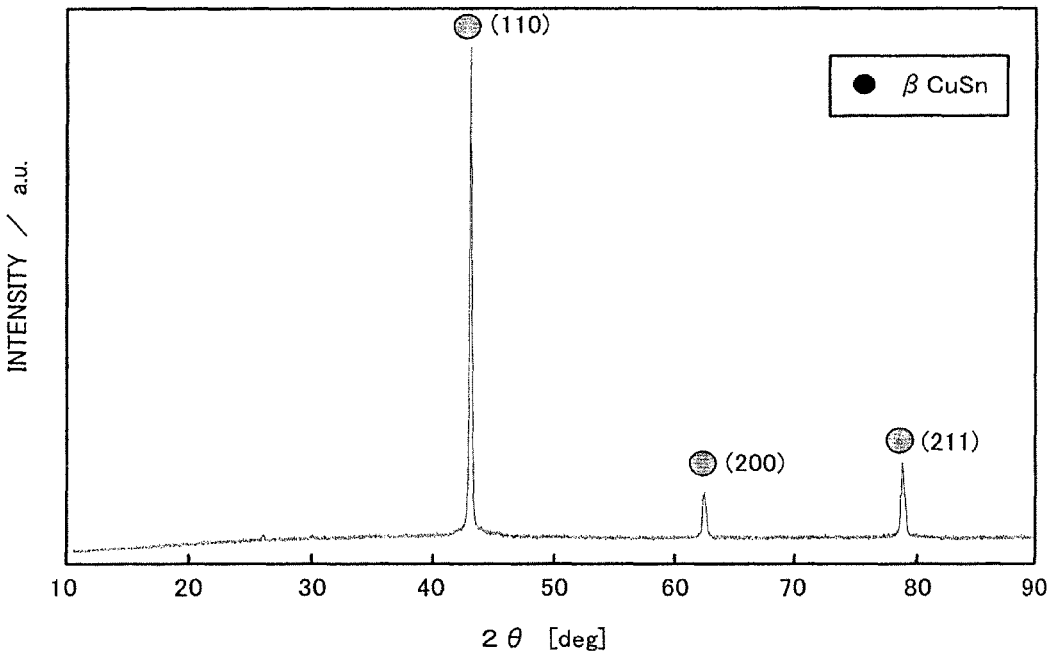
FIG. 10 shows XRD measurement results of Experimental Example 2.

FIG. 9 shows XRD measurement results of Experimental Example 1. The intensity profile of the Experimental Example 1 was analyzed, and it was found that the constituent phase was βCuSn. In other words, almost all of the phases were βCuSn. The lattice constant was 2.97 Ø, which was slightly smaller than the literature value, 3.03 Ø. This lattice constant was small even when compared a Cu—13 at % Sn-3.8 at % Al alloy composed of βCuSn and belonging to the same Cu—Sn—Al copper alloy. FIG. 10 shows XRD measurement results of Experimental Example 2. The intensity profile of the Experimental Example 2 was analyzed, and it was found that, the constituent phase was βCuSn. In other words, almost all of the phases were βCuSn. The lattice constant of Experimental Example 2 was also 2.97 Ø, which was slightly smaller than the literature value, 3.03 Ø and was not much different from Experimental Example 1. This shows that in the Cu—Sn—Al copper alloy with Al dissolved therein, βCuSn is stably present even after passage of time.

The constituent phase of Experimental Example 1 was βCuSn. The result, that this sample exhibits the shape memory effect and has thermal martensite emerged therein is reasonable. Considerations will now be made on deviation of the sample structure from βCuSn ($Cu_{85}Sn_{15}$), which is assumed to be the reason behind the lattice constant being smaller than the literature value. The Cu content of βCuSn ($Cu_{85}Sn_{15}$) that balances with 10 at % Sn contained in Cu-10 at % Sn-8.6 at % Al is 10/15×85=about 57 at % Cu; and this indicates that Cu-10 at % Sn-8.6 at % Al is βCuSn with less Sn and more Cu and Al dissolved therein. Cu and Al have smaller atomic radii than Sn. Thus it is considered that the lattice constant was smaller because Cu and Al, which have smaller atomic radii than Sn, were dissolved in βCuSn. The lattice constant was smaller than Cu-13 at % Sn-3.8 at % Al, which belonged to the same Cu—Sn—Al group and was constituted by βCuSn, probably because the sample composition was further deviated from βCuSn ($Cu_{85}Sn_{15}$). The constituent phase of Experimental Example 2 was βCuSn. The result that this sample exhibits the shape memory effect and has thermal martensite emerged therein is reasonable. The intensity profile was not much different from Experimental Example 1 probably because the precipitates, such as the s phase, and the L phase reported to be the cause for room-temperature aging, were so fine that they did not affect the intensity.

Figure 11A:
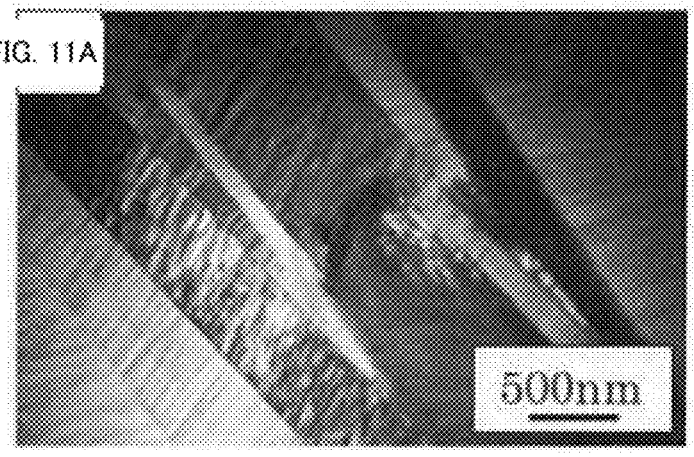
FIGS. 11A and 11B show TEM observation results of Experimental Example 1.
Figure 11B:
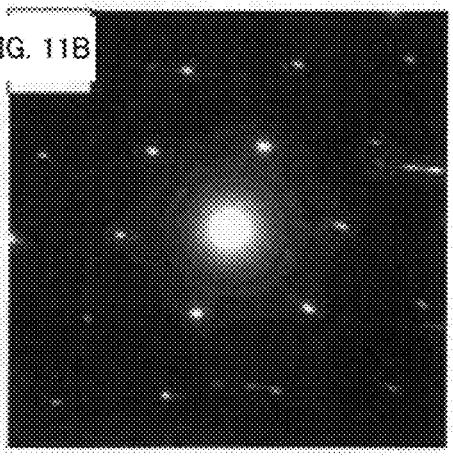
Figure 12A:
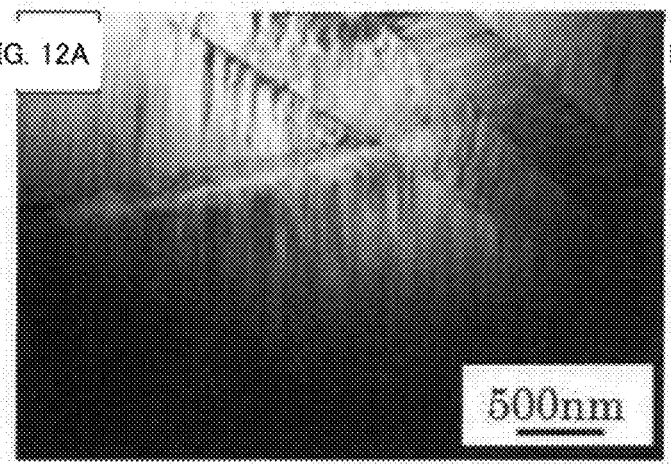
FIGS. 12A and 12B show TEM observation results of Experimental Example 2.
Figure 12B:
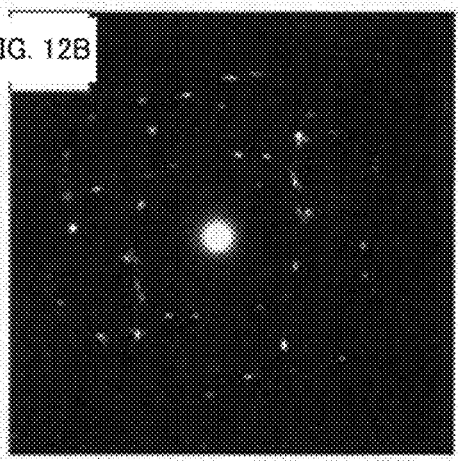

FIGS. 11A and 11B show the TEM observation results of Experimental Example 1. In the TEM photograph of Experimental Example 1, thermal martensite was observed. In the electron diffraction pattern, many superfluous wing-shaped diffraction mottles were observed. FIGS. 12A and 12B show the TEM observation results of Experimental Example 2. In the TEM photograph of Experimental Example 2, thermal martensite was observed as in Experimental Example 1. In the electron diffraction pattern, many superfluous wing-shaped diffraction mottles were observed. In Experimental Example 1, many superfluous wing-shaped diffraction mottles were observed in the electron diffraction pattern. This is presumably due to the s phase and the L phase that emerge by room-temperature aging. The s phase and the L phase also emerged in Experimental Example 1 under TEM observation presumably because the steps of electrolytically polishing and observation performed after the homogenization step each took a long time, and room-temperature aging occurred in some part during that time. In Experimental Example 2, many superfluous wing-shaped diffraction mottles were observed in the electron diffraction pattern. This is presumably due to the s phase and the L phase that emerge by room-temperature aging. The s phase and the L phase are considered to be the cause for changes in shape memory properties by room-temperature aging. The presence of the s phase and the L phase is considered to consistent with changes in shape memory properties. In Experimental Examples 1 and 2, although some degree of phase changes were observed, the changes were not significant enough to cause loss of the shape memory properties, and it was assumed that addition of Al further suppressed room-temperature aging.

The present application claims priority from U.S. provisional Patent Application No. 62/313,228 filed on Mar. 25, 2016, the entire contents of which are incorporated herein by reference.

What is claimed is:

1. A copper alloy having an alloy composition represented by $Cu_{100-(x+y)}Sn_xAl_y$, where $8 \le x \le 12$ and $8 \le y \le 9$ are satisfied, wherein a main phase is a βCuSn phase with Al dissolved therein, and the βCuSn phase undergoes martensitic transformation when heat-treated or worked, wherein an elastic recovery (%) determined from an angle θ observed when a flat plate of the copper alloy is unloaded after being bent at a bending angle of 45° is 40% or more.

2. The copper alloy according to claim 1, having at least one selected from a shape memory effect and a super elastic effect at a temperature equal to or lower than a melting point.

3. The copper alloy according to claim 1, wherein, a thermal recovery (%) determined from an angle θ observed when a flat plate of the copper alloy is heated to a recovery temperature after being bent at a bending angle of 45° is 40% or more.

4. The copper alloy according to claim 1, wherein an elastic thermal recovery (%) determined from an angle $\theta_1$, which is observed when a flat plate of the copper alloy is unloaded after being bent at a bending angle of 45°, and an angle $\theta_2$, which is observed when the flat plate is further heated to a recovery temperature, is 80% or more.

5. The copper alloy according to claim 1, wherein, in surface observation, an area ratio of the βCuSn phase contained is in a range of 50% or more and 100% or less.

6. The copper alloy according to claim 1, comprising a polycrystal or a single crystal.

7. The copper alloy according to claim 1, wherein the copper alloy is homogenized.

8. A method for producing a copper alloy that undergoes martensitic transformation when heat-treated or worked, wherein, among a casting step of melting and casting a raw material containing Cu, Sn, and Al and having an alloy composition represented by $Cu_{100-(x+y)}Sn_xAl_y$, where $8 \leq x \leq 12$ and $8 \leq y \leq 9$ are satisfied, so as to obtain a cast material, and a homogenization step of homogenizing the cast material in a temperature range of a βCuSn phase so as to obtain a homogenized material, the method comprises at least the casting step, wherein a main phase is a βCuSn phase with Al dissolved therein wherein an elastic recovery (%) determined from an angle θ observed when a flat plate of the copper alloy is unloaded after being bent at a bending angle of 45° is 40% or more.

9. The method for producing a copper alloy according to claim 8, wherein, in the casting step, the raw material is melted in a temperature range of 750° C. or higher and 1300° C. or lower, and cooled from 800° C. to 400° C. at a cooling rate of −50° C./s to −500° C./s.

10. The method for producing a copper alloy according to claim 8, wherein, in the homogenization step, the cast material is held in a temperature range of 600° C. or higher and 850° C. or lower and then cooled at a cooling rate of −50° C./s to −500° C./s.

11. The method for producing a copper alloy according to claim 8, further comprising:

at least one working step of cold-working or hot-working at least one selected from the cast material and the homogenized material into at least one shape selected from a plate shape, a foil shape, a bar shape, a line shape, and a particular shape.

12. The method for producing a copper alloy according to claim 11, wherein, in the working step, hot-working is conducted in a temperature range of 500° C. or higher and 700° C. or lower and then cooling is conducted at a cooling rate of −50° C./s to −500° C./s.

13. The method for producing a copper alloy according to claim 11, wherein, in the working step, working is conducted by a method that suppresses occurrence of shear deformation so that a reduction in area is 50% or less.

14. The method for producing a copper alloy according to claim 8, further comprising:

an aging or ordering step of subjecting at least one selected from the cast material and the homogenized material to an age hardening treatment or an ordering treatment so as to obtain an age-hardened material or an ordered material.

* * * * *